United States Patent [19]

Kambara

[11] 4,159,423

[45] Jun. 26, 1979

[54] CHEMICAL IONIZATION ION SOURCE

[75] Inventor: Hideki Kambara, Kodaira, Japan

[73] Assignee: Hitachi, Ltd., Tokyo, Japan

[21] Appl. No.: 836,963

[22] Filed: Sep. 27, 1977

[30] Foreign Application Priority Data

Oct. 1, 1976 [JP] Japan ..... 51/117153

[51] Int. Cl.[2] ..... H01J 27/00

[52] U.S. Cl. ..... 250/423 R; 250/427

[58] Field of Search ..... 250/423 R, 427, 282, 250/281, 288; 313/362, 306, 309

[56] References Cited

U.S. PATENT DOCUMENTS

| | | | |
|---|---|---|---|
| 3,173,248 | 3/1965 | Curtis et al. | 313/362 |
| 3,265,889 | 8/1966 | Doctoroff | 250/427 |
| 3,639,757 | 2/1972 | Caroll et al. | 250/288 |
| 3,849,656 | 11/1974 | Wallington | 250/423 |

*Primary Examiner*—Bruce C. Anderson

*Attorney, Agent, or Firm*—Craig and Antonelli

[57] ABSTRACT

A chemical ionization ion source comprising a firt electrode disposed in a discharge region, a counter electrode disposed to confront the first electrode and having at least one space for introducing electrons generated in the discharge region into an ionization region and means for maintaining the counter electrode at a potential higher than that of the first electrode and applying a direct current voltage between the two electrodes, wherein the discharge region and the ionization region are maintained under substantially the same pressures.

7 Claims, 4 Drawing Figures

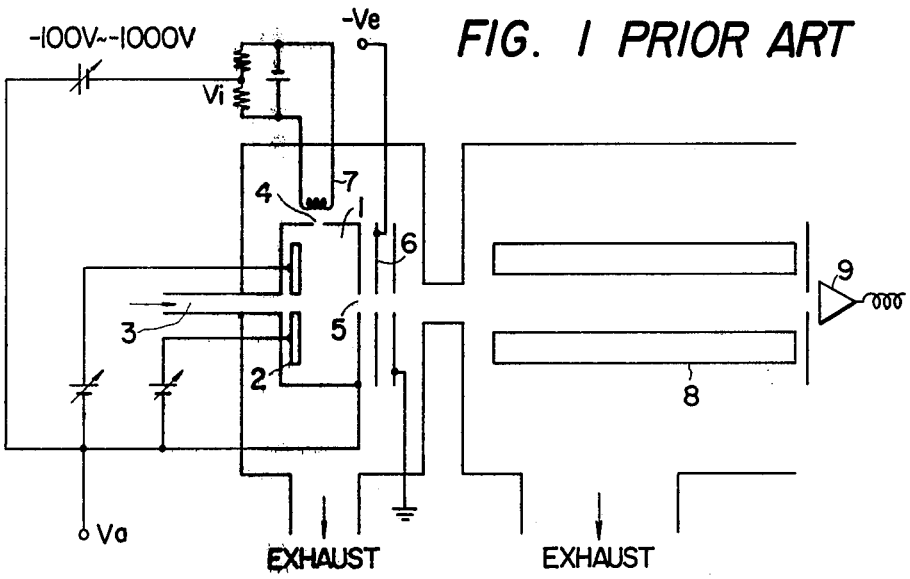
FIG. 1 PRIOR ART
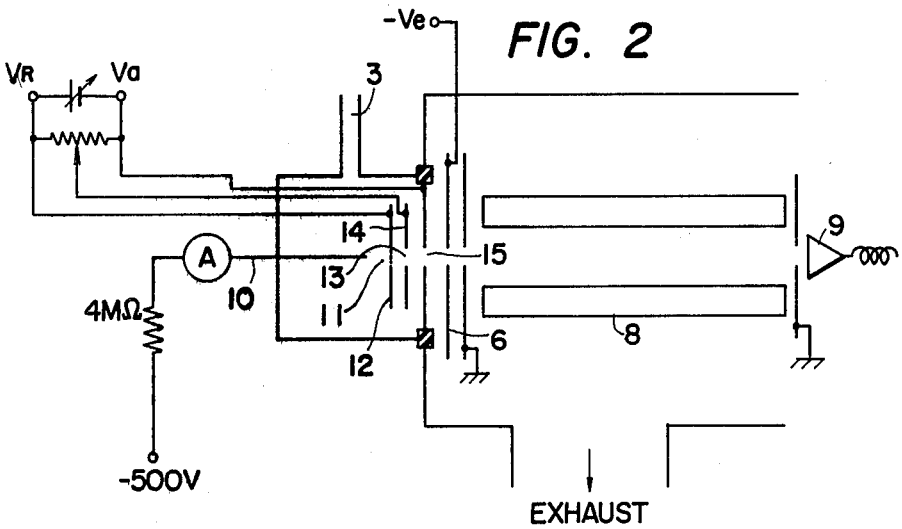
FIG. 2
FIG. 3-A
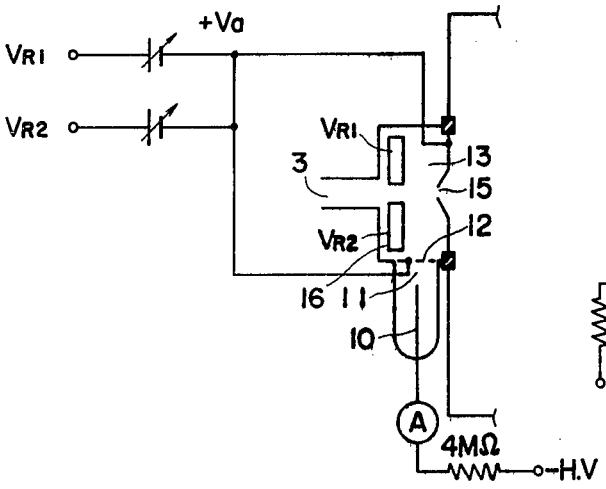
FIG. 3-B
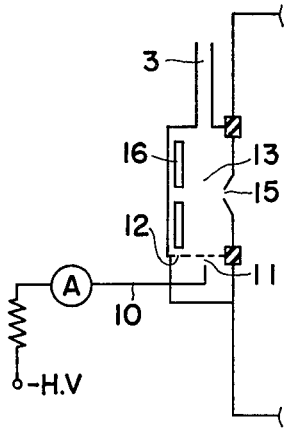

CHEMICAL IONIZATION ION SOURCE

BACKGROUND OF THE INVENTION (1) Field of the Invention

The present invention relates to an ion source of a mass spectrometer or the like. More particularly, the present invention relates to an improvement in the chemical ionization ion source.

(2) Description of the Prior Art

The chemical ionization and equipments for accomplishing the chemical ionization are described in detail in, for example, Analytical Chemistry, 47, No. 11, pages 1730–1734, September 1975, the specification of U.S. Pat. No. 3,555,272 and the specification of Japanese Patent Application Publication No. 36190/75.

Ionization is one of the methods for ionizing a sample. The present invention relates to a soft ionization method utilizing ion-molecule reactions between reactant ions having a low energy corresponding almost to a thermal kinetic energy and the sample. According to this method, a pressure of 0.1 to several mm Hg (Torr) is maintained in an ionization chamber and in this chamber a reagent gas is ionized by electron impact, whereby ion-molecule reaction is caused between the resulting ion and a neutral reagent gas and a stable reactant ion is formed. Then, the sample is ionized by an ion-molecule reaction between this reactant ion and the sample.

FIG. 1 illustrates a mass spectrometer provided with a conventional chemical ionization ion source. In FIG. 1, reference numeral 1 represents an ionization chamber, numeral 2 represents repeller electrodes for pushing out ions formed in the ion source, numeral 3 an inlet for reagent gas and sample gas, numeral 4 a slit, numeral 5 a slit, numeral 6 a lens electrode, numeral 7 an electron gun, numeral 8 a mass analyzing region, and reference numeral 9 represents a detecting region. As is apparent from FIG. 1, in the conventional chemical ionization ion source, electrons generated by the electron gun 7 maintained under a pressure lower than $10^{-4}$ mm Hg are accelerated by a voltage of several hundred volts to about 1 KV and introduced into the ionization chamber 1 maintained under a pressure of 0.1 to several mm Hg thereby creating a pressure gradient between the electron gun 7 and the ionization chamber 1. In the ionization chamber 1 the reagent gas is ionized by impacts with these accelerated electrons. In this conventional chemical ionization ion source, a differential evacuation should be conducted between the ionization chamber 1 and the electron gun 7, and they should be partitioned in a vacuum by an electrode having a slit (in general, 0.025–0.05 mm×3–5 mm in size). Because of the presence of this slit, introduction of electrons emitted from the electron gun 7 into the ionization chamber 1 is limited, and hence, the efficiency of utilization of generated electrons is very low. Further, since a heating filament is ordinarily used as the electron gun 7, the sample is thermally decomposed and the ionization chamber or slit is readily contaminated. This is another defect of the conventional ion source. Moreover, this contamination of the slit results in unstable currents of electrons introduced in the ionization chamber and consequently in instability of the quantity of produced ions. Still further, in the case where an electron source including a heating element is employed, if a corrosive gas is used as the reagent gas, the filament is damaged. Accordingly, it is not desired to use a corrosive gas such as $O_2$ or $H_2O$. Furthermore, in order to measure the pressure of the ionization chamber 1 in an ion source having the above structure, it is necessary to dispose therein a vacuum gauge such as a MacLeod gauge. Hence, the capacity of the ionization chamber 1 must be increased. If the dead volume of the ion source is large, troubles are caused in the practical operation. For example, the injected sample is hardly taken out from the ion source but is left for an indefinite time. Therefore, provision of such vacuum gauge in the chemical ionization ion source is not preferred.

SUMMARY OF THE INVENTION

It is a primary object of the present invention to provide an improved chemical ionization ion source having a simple structure, in which any reagent gases may be conveniently used.

In accordance with the present invention, this and other objects can be attained by a chemical ionization ion source comprising a discharge region, an ionization region, a gas inlet and a sampling hole, where electrons generated in said discharge region are irradiated on a gas mixture of a reagent gas and sample gas introduced into said ionization region from the gas inlet, the sample gas is ionized by utilizing ion-molecule reactions and the resulting ions are emitted from said sampling hole. This chemical ionization ion source is characterized in that it further comprises (a) at least one first electrode disposed in said discharge region, which is selected from the group consisting of needle electrodes, knife-edge electrodes, wire electrodes and activated wire electrodes and, (b) a counter electrode disposed to confront the first electrode and having at least one space for introducing electrons generated in the discharge region into said ionization region, wherein said discharge region and ionization region are maintained under substantially the same pressures through at least said space.

BRIEF DESCRIPTION OF THE DRAWING

FIG. 1 is a diagram illustrating a mass spectrometer comprising a conventional chemical ionization ion source.

FIG. 2 is a diagram illustrating one embodiment of the chemical ionization ion source according to the present invention.

FIGS. 3-A and 3-B are diagrams illustrating other embodiments of the present invention.

DETAILED DESCRIPTION OF THE PREFERRED EMBODIMENTS

The present invention will now be described in detail.

To begin with, the principle of the chemical ionization will be described.

As pointed out herein before, in conducting the chemical ionization, the pressure in the ionization chamber is maintained under 0.1 to several mm Hg. Assuming that the cross section of inelastic collosions (including ionization) is $5\times10^{-16}$ cm$^2$, the mean free path under such pressure is 0.5 mm. Accordingly, if electrons generated by some means are accelerated in a strong electric field and an energy sufficient to ionize molecules is given to the electrons during collision intervals, chemical ionization will occur due to molecular ionization caused by electron impact. In general, the ionization potentials of organic molecules are lower than 15 eV and therefore, it is sufficient that the electric field for accelerating electrons has an intensity of at least 30 V/mm.

Assuming that an electric field is formed by a needle electrode and a counter plate electrode, between which a potential difference $V_o$ is applied, the intensity E of this electric field is expressed as follows:

$$E(x)=V_o/x \ln(2R/r_o) \quad (1)$$

wherein $r_o$ stands for the curvature of the top end of the needle electrode, R designates the distance between the top end of the needle electrode and the counter plate electrode, and x stands for the distance between the center of the curvature of the needle electrode and the point for measurement of the intensity E of the electric field.

If $r_o$ is 0.03 mm, R is 4 mm, $V_o$ is 500 V and x is 3 mm, E(3)

then E(3)=30 V/mm

This means that electrons for chemical ionization can be supplied by a townsend discharge effected between the needle electrode and counter electrode under a pressure of 1 mm Hg.

This is established not only in the above case where a townsend discharge is effected between the needle electrode and the plate electrode but also in the case where a knife-edge electrode or wire electrode is used instead of the needle electrode, or where a mesh electrode or slit electrode is used instead of the counter plate electrode.

Moreover, the above-mentioned fact means that in the chemical ionization ion source of the present invention, a very simple electron-generating source may be used that generates electrons under the same vacuum as in the ionization chamber thereby enhancing the efficiency of the utilization of electrons. Moreover, since no incandescent filament is used, a corrosive gas can be used as the reagent gas.

The present invention will now be described in detail by reference to embodiments illustrated in the accompanying drawing.

Referring to FIG. 2 illustrating one embodiment of the present invention, reference numeral 10 represents a needle electrode, 11 a discharge region, 12 a counter mesh electrode, 13 an ionization region, 14 an ion-focussing electrode and reference numeral 15 represents a sampling fine hole. A direct current voltage is applied between the needle electrode 10 and the counter mesh electrode 12 with the latter being the more positive electrode. As is seen from FIG. 2, since the intensity of the electric field in the vicinity of the needle electrode is very high in this embodiment, electrons are accelerated to ionize molecules present in the vicinity of the top end of the needle to thereby cause a discharge. Thus, the generated electrons are allowed to drift toward the mesh electrode 12. When an appropriate potential difference is provided between the mesh electrode 12 and the needle electrode 10, since the pressure in the discharge region is higher, the electrons lose their energy on collision, but while they are successively amplified through this ionization process, they arrive at the mesh electrode 12. For example, if a potential difference of at least about 500 V is applied with the distance being 3 mm, when the accelerated electrons arrive at the mesh electrode 12, they are provided with an energy sufficient to ionize molecules.

On the side of the sampling fine hole with the mesh electrode 12 being as the boundary, an electric field is applied so that ions are allowed to drift toward the sampling fine hole. For example, when positive ions are allowed to drift, an electric field of a polarity reversed from that of the discharge region 11 is applied. Namely, a positive potential equal to or lower than that of the mesh electrode 12 is applied to the ion-focussing electrode 14.

The electrons that have passed through the mesh electrode 12 are decelerated and are extinguished meanwhile on impinging against the electrode or the like. However, before the extinction, the electrons ionize molecules which form the primary ions necessary for the chemical ionization. While these primary ions are drifting toward the fine hole 15 under the influence of the electric field, they collide with neutral molecules of the sample and thereby cause an ion-molecule reaction, whereby the sample molecules are ionized and the chemical ionization is accomplished. These sample ions are taken out to the analyzing region through the sampling fine hole 15.

In the foregoing embodiments, a counter electrode having fine holes may be used instead of the counter mesh electrode. In this case, however, the size of the fine hole 15 is dictated only by the leakage of the electric field from the discharge region to the ionization region, and the size of the fine hole can be made much larger than the size of the slit 4 for a differential evacuation such as is shown in FIG. 1. Accordingly, the above-mentioned disadvantages involved in the conventional technique are obviated.

Furthermore, in the embodiment illustrated in FIG. 2, the needle electrode 10, the mesh electrode 12 and an aperture electrode having the fine hole 15 are arranged in series. In general, primary ions (reactor ions formed by electron impart) collide with the sample to cause chemical ionization, but only a very small percentage of the thus formed ions enter the analyzing region through the fine hole 15. These ions are generated in the vicinity of the axis vertical to the aperture electrode with the fine hole thereof comprising the starting point. When a series structure as in the present embodiment is adopted so that electrons are injected along this axis and ions are generated only in the vicinity of the axis, effective ionization can be accomplished by using a small quantity of electrons. The fact that the quantity of electrons can be reduced means that decomposition of an organic substance by electron impact and subsequent contamination of the ion source can be remarkably diminished.

When the experiment was carried out in the foregoing embodiment by using methane as a carrier gas (reagent gas), it was found that if a voltage of 500 V was applied under a pressure of 0.5 Torr between the needle electrode 10 and the mesh electrode 12, an electron current of about 20 $\mu$A was obtained. Monitoring and detection of the quantity of this electron current, namely the discharge current, was performed by inserting an ampere meter between the needle electrode and a high resistance (about 4 M$\Omega$) as shown in FIG. 2. Since substantially all of the electron current was introduced into the ionization region 13 and was effectively utilized for formation of primary ions, an ion current of a sufficient intensity could be obtained with a small quantity of the electron current on the order of 10 $\mu$A. For example, when the diameter of the sampling fine hole 15 was adjusted to 0.3 mm, the total quantity of ions introduced into the mass analyzing region 8 was $1\times10^{-10}$ A. In view of the fact that in order to obtain the same quantity of ions in the ion source illustrated in FIG. 1, the quantity of the electron current generated from the electron gun should necessarily be as high as 150 to 200 μA, it is apparent that the above effect of reducing the quantity of the electron current is very conspicuous. In the present embodiment, since the quantity of the electron current is drastically reduced and filaments are not used at all, occurrence of troubles by contamination with organic substances can be remarkably diminished and the life of the ion source can be substantially prolonged. Still further, since the needle electrode is employed, a high corrosion resistance can be expected and $H_2O$ and $O_2$ can be used as the reagent gas. As in the conventional ionization process, reactant ions such as $CH_5^+$ and $C_2H_5^+$ can be used in the present invention.

Additionally, in the present invention, since the quantity of the discharge current is varied depending on the pressure in the ionization chamber, if a calibration curve has been determined in advance, it is possible to know the pressure in the ionization region from the value of the discharge current quantity on the ampere meter.

FIGS. 3-A and 3-B illustrate other embodiments of the present invention, which are different from the embodiment shown in FIG. 2 in that electrons are obtained from the side of the ionization region 13. In FIGS. 3-A and 3-B, the arrangement illustrated is the same as the arrangement shown in FIG. 2 except that repeller electrodes 16 are used. The mass analyzing region and subsequent regions are not illustrated in FIGS. 3-A and 3-B. In the embodiment shown in FIG. 3-A, a discharge region 11 is partitioned by a mesh electrode 12 constituting one lateral wall of an ionization region, and the side wall of the discharge region 11 is composed of glass. On the other hand, in the embodiment shown in FIG. 3-B, the discharge region 11 is defined by the mesh electrode 12 in the interior of the ionization chamber.

In the foregoing embodiments, one such as needle electrode is used as the first electrode and a mesh electrode is used as the counter electrode. In the present invention, electrodes of the type such that a strong electric field can be produced around the first electrode, needle electrodes, knife edge electrodes, wire electrodes and activated electrodes having carbon needles grown thereon, can be used for the first electrode. In addition to the mesh electrode, slit electrodes, electrodes having fine holes and the like can be used as the counter electrode. Since the main action of the counter electrode in the present invention is to separate the discharge region from the ionization region, the size of the slit can be made about 10 times as large as the slit size in the conventional ion source. When a magnetic sector type mass spectrometer is used for a mass analyzer, since the sampling fine hole 15 is desired to have a slit shape, it is especially preferred that a plurality of needle electrodes, a knife edge electrode or a fine wire electrode (inclusive of those having micro-needles formed on the surface thereof) arranged in series be used as the first electrode and an electrode having a slit having a width of about 0.5 mm be used as the counter electrode. In this case, it is especially preferred that the longitudinal direction of the first electrode be identical with the longitudinal directions of the slit of the counter electrode and the fine hole 15.

Further, as illustrated in FIG. 2, it is not necessary to separate these two regions strictly.

Various advantages such as mentioned below can be attained by the chemical ionization ion source of the present invention having the above structure.

(1) The ion source has a very simple structure and a long life, and a corrosive gas can be used as the reagent gas.

(2) Since a sufficient quantity of ions can be obtained by a low electron current, contamination of the ionization chamber can be remarkably reduced.

(3) Since the electron source is maintained under the same pressure as that in the ionization chamber, differential evacuation for taking out ions can be accomplished conveniently by the fine hole.

(4) The pressure in the ionization chamber can be measured.

What is claimed is:

1. A chemical ionization ion source comprising a discharge region, an ionization region, a gas inlet and a sampling hole, where electrons generated in said discharge region are irradiated on a gas mixture of reagent gas and sample gas introduced into said ionization region from the gas inlet, said sample gas being ionized by ion-molecule reaction, the resulting ions being emitted from said sampling hole, said chemical ionization ion source being characterized in that said discharge region further comprises (a) at least one first electrode disposed in said discharge region, which is selected from the group consisting of needle electrodes, a knife-edge electrode, a wire electrode and an activated wire electrode having carbon needles grown thereon and (b) a counter electrode disposed to confront the first electrode and having at least one space for introducing electrons generated in the discharge region into said ionization region, wherein said discharge region and ionization region are maintained under substantially the same pressures through at least said counter electrode space.

2. A chemical ionization ion source as set forth in claim 1 wherein ion moving means are disposed to cause ions formed by said ion-molecule reaction to drift to said sampling hole.

3. A chemical ionization ion source as set forth in claim 2 wherein said ion moving means is an electrode which is disposed in the vicinity of said sampling hole of said ionization region and has a hole through which said ions can pass.

4. A chemical ionization ion source as set forth in claim 2 wherein said ion moving means is an electrode disposed on the side opposite said sampling hole of said ionization region.

5. A chemical ionization ion source as set forth in claim 1 wherein the counter electrode is a mesh electrode.

6. A chemical ionization ion source as set forth in claim 1 wherein a plurality of electrodes selected from the group consisting of needle electrodes, a knife-edge electrode and a wire electrode are arranged in series in a longitudinal direction as the first electrode, the counter electrode is an electrode having a slit, said sampling fine hole is a strip-like slit, and the longitudinal direction of said first electrode is identical with the longitudinal direction of the slit of the counter electrode and the longitudinal direction of said sampling fine hole.

7. A chemical ionization ion source as set forth in claim 1, wherein the counter electrode is an electrode having a slit.

* * * * *